US006469264B2

(12) United States Patent
Benda

(10) Patent No.: US 6,469,264 B2
(45) Date of Patent: Oct. 22, 2002

(54) SWITCH LEVER LOCK OUT ASSEMBLY

(75) Inventor: Steven J. Benda, Cokato, MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 09/771,819

(22) Filed: Jan. 29, 2001

(65) Prior Publication Data

US 2002/0100666 A1 Aug. 1, 2002

(51) Int. Cl.[7] ..... H01H 9/28

(52) U.S. Cl. ..... 200/43.14; 200/43.16; 200/43.19; 200/43.21

(58) Field of Search ..... 200/43.01, 43.11, 200/43.14–43.16, 43.19, 43.21, 43.22, 50.32, 50.33, 50.37, 50.4

(56) References Cited

U.S. PATENT DOCUMENTS

| | | | | |
|---|---|---|---|---|
| 2,169,860 A | | 8/1939 | Van Hoorn | 70/203 |
| 2,937,248 A | | 5/1960 | Michetti | 200/44 |
| 2,978,613 A | | 4/1961 | Hein | 317/119 |
| 3,109,899 A | | 11/1963 | Pastene | 200/42 |
| 3,408,466 A | | 10/1968 | Palmer | 200/42 |
| 3,629,529 A | | 12/1971 | Dietz | 200/42 |
| 3,784,766 A | | 1/1974 | Johnson | 200/42 |
| 4,006,324 A | | 2/1977 | Leasher | 200/42 |
| 4,300,030 A | | 11/1981 | Dimarco | 200/42 |
| 4,733,029 A | | 3/1988 | Kobayashi | 200/43.15 |
| 5,148,910 A | | 9/1992 | Williams | 200/43.19 |
| 5,270,503 A | | 12/1993 | Frye | 200/43.14 |
| 5,300,740 A | | 4/1994 | Benda | 200/43.14 |
| 5,322,980 A | | 6/1994 | Benda | 200/43.014 |
| 5,500,495 A | * | 3/1996 | Benda et al. | 200/43.14 |
| 5,593,020 A | | 1/1997 | Alexander | 200/43.14 |
| 5,648,646 A | | 7/1997 | Flegel | 200/50.32 |
| 5,732,815 A | * | 3/1998 | Brouwer | 200/43.11 |
| 5,772,007 A | * | 6/1998 | Frye | 200/43.14 |
| 5,794,760 A | | 8/1998 | Alexander | 200/43.14 |
| 5,900,600 A | | 5/1999 | Alexander | 200/43.14 |
| 6,266,231 B1 | * | 7/2001 | Donahue et al. | 200/43.11 |

FOREIGN PATENT DOCUMENTS

| | | | |
|---|---|---|---|
| FR | 2424619 | 4/1978 | H01H/9/22 |

* cited by examiner

*Primary Examiner*—Michael Friedhofer
(74) *Attorney, Agent, or Firm*—Quarles & Brady LLP

(57) ABSTRACT

A switch lever lock out assembly which is engagable with a switch having a lever positionable in at least two positions. The assembly includes a lock rail fixable relative to the switch. At least one transverse opening is formed in the lock rail. One end of an elongated lock arm extends through the opening and an opposing end extends toward the switch. In one aspect of the present invention, a switch engageable head is fixed to the lock arm opposing end, and is clampable to the lever. In another aspect of the invention, the head is slidably mounted to the lock arm. In yet another aspect of the present invention, the head is fixed to the lock arm, and offset from a lock aim longitudinal axis.

49 Claims, 6 Drawing Sheets

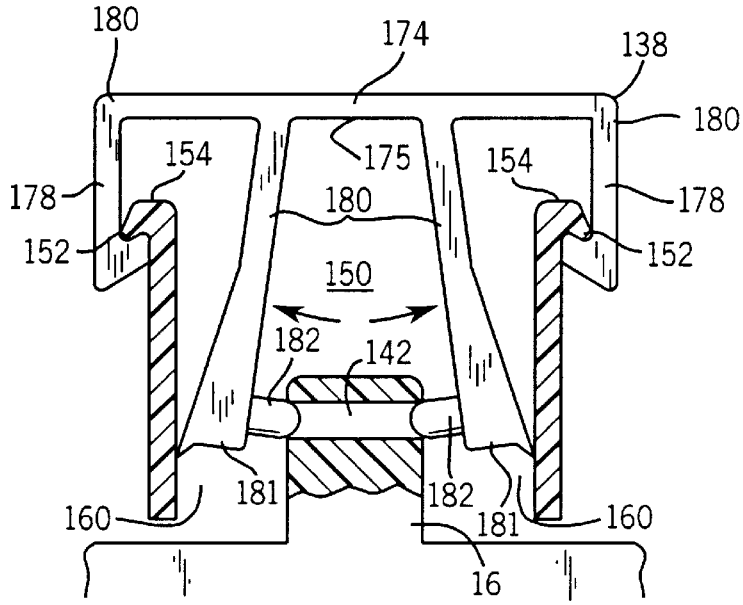
FIG. 15
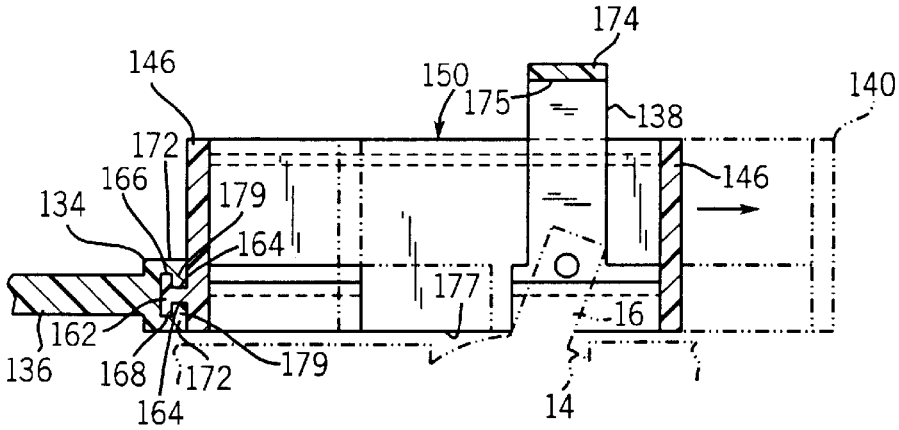
FIG. 16
FIG. 17
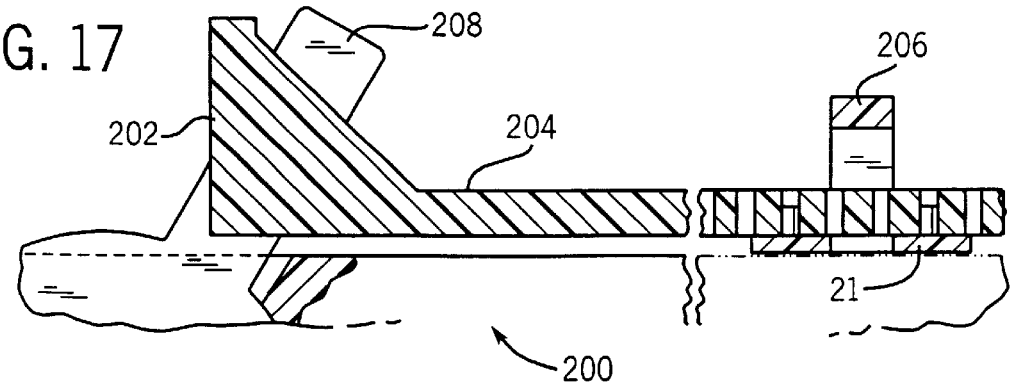

SWITCH LEVER LOCK OUT ASSEMBLY

CROSS REFERENCES TO RELATED APPLICATIONS

Not Applicable

STATEMENT REGARDING FEDERALLY SPONSORED RESEARCH

Not Applicable

BACKGROUND OF THE INVENTION

The field of invention is switch lever lock outs for locking switch levers in a desired position, and more particularly to switch lever lock outs which have one end positively engaging the lever and another end engaging a fixed rail.

Switches are used in many applications to control the flow of electrical energy. The switches can be used to redirect electrical energy from one circuit to another, and can be used to stop the flow of electrical energy through a circuit. In both cases the circuits become de-energized, that is without a voltage. One particular type of switch is a circuit breaker which cuts off the flow of electrical energy when the flow of electrical energy through the switch exceeds a predetermined value. Many of these circuit breakers include a lever which is movable between an "On" position and an "Off" position.

Maintenance personnel often use a circuit breaker to cut the flow of electrical energy through a circuit when the circuit, or electrical components connected thereto, require maintenance. The circuit breaker, however, is often remote from the location requiring maintenance. Therefore, it is desirable to lock out the circuit breaker to prevent an individual from inadvertently energizing the circuit while maintenance is being performed.

Known circuit breaker lock out assemblies engage the circuit breaker lever to prevent unauthorized movement of the lever. Lockouts, such as disclosed in U.S. Pat. Nos. 5,593,020; 5,794,760, and 5,900,600, include a lock arm cantilevered from a lock rail. The lock arm includes a head which engages or covers the circuit breaker lever to prevent unauthorized movement of the lever. This particular type of lock out can be easily circumvented by lifting the cantilevered head away from the lever to disengage the lever from the head. As a result, the lock out adequately serves to provide notice to an individual that movement of the lever is unauthorized, however, it is not always effective to prevent unauthorized lever movement.

Another disadvantage of the prior art cantilevered lock outs is the inability to lock out adjacent circuit breakers aligned along an axis perpendicular to the lock rail. Only one opening in the lock rail can be used to hold a cantilevered lock arm, and each lock arm can lock out only one circuit breaker. In addition, the prior art cantilevered lock out assemblies disclosed in the above referenced patents include components formed from different materials, or otherwise not easily formed using injection molding techniques to minimize fabrication costs. Therefore, a need exists for an effective switch lock out which can be fabricated using injection molding techniques.

BRIEF SUMMARY OF THE INVENTION

The present invention provides a switch lever lock out assembly which is engagable with a switch having a lever positionable in at least two positions. The assembly includes a lock rail fixable relative to the switch. At least one transverse opening is formed in the lock rail. One end of an elongated lock arm extends through the opening and an opposing end extends toward the switch. In one aspect of the present invention, a switch engageable head is fixed to the lock arm opposing end, and is clampable to the lever. In another aspect of the invention, the head is slidably mounted to the lock arm. In yet another aspect of the present invention, the head is fixed to the lock arm, and offset from a lock arm longitudinal axis.

A general objective of the present invention is to provide a switch lock out assembly which is easily fabricated. This objective is accomplished by providing a lock out assembly which can be fabricated by injection molding.

Another objective of the present invention is to provide a switch lock out which is not easily circumvented. This objective is accomplished by providing a switch lock out assembly which includes a lock arm having a head which clamps onto the switch lever to prevent the head from being lifted off of the lever while the switch is locked out.

Yet, another objective of the present invention is to provide a switch lock out assembly which can lock out adjacent switches. This objective is accomplished by providing a switch lock out assembly which includes a lock aim having a head which is offset or slidably movable relative to the lock arm.

The foregoing and other objects and advantages of the invention will appear from the following description. In the description, reference is made to the accompanying drawings which form a part hereof, and in which there is shown by way of illustration a preferred embodiment of the invention.

BRIEF DESCRIPTION OF THE DRAWINGS

FIG. 15 is a sectional view of the lock arm assembly of FIG. 13 in a disengaged position with a circuit breaker lever;

FIG. 16 is a lengthwise sectional view of the lock arm assembly of FIG. 13; and FIG. 17 is a sectional view of a fifth embodiment of a lock arm assembly along line 17—17 of FIG. 1.

DETAILED DESCRIPTION OF THE PREFERRED EMBODIMENTS

Figure 1:
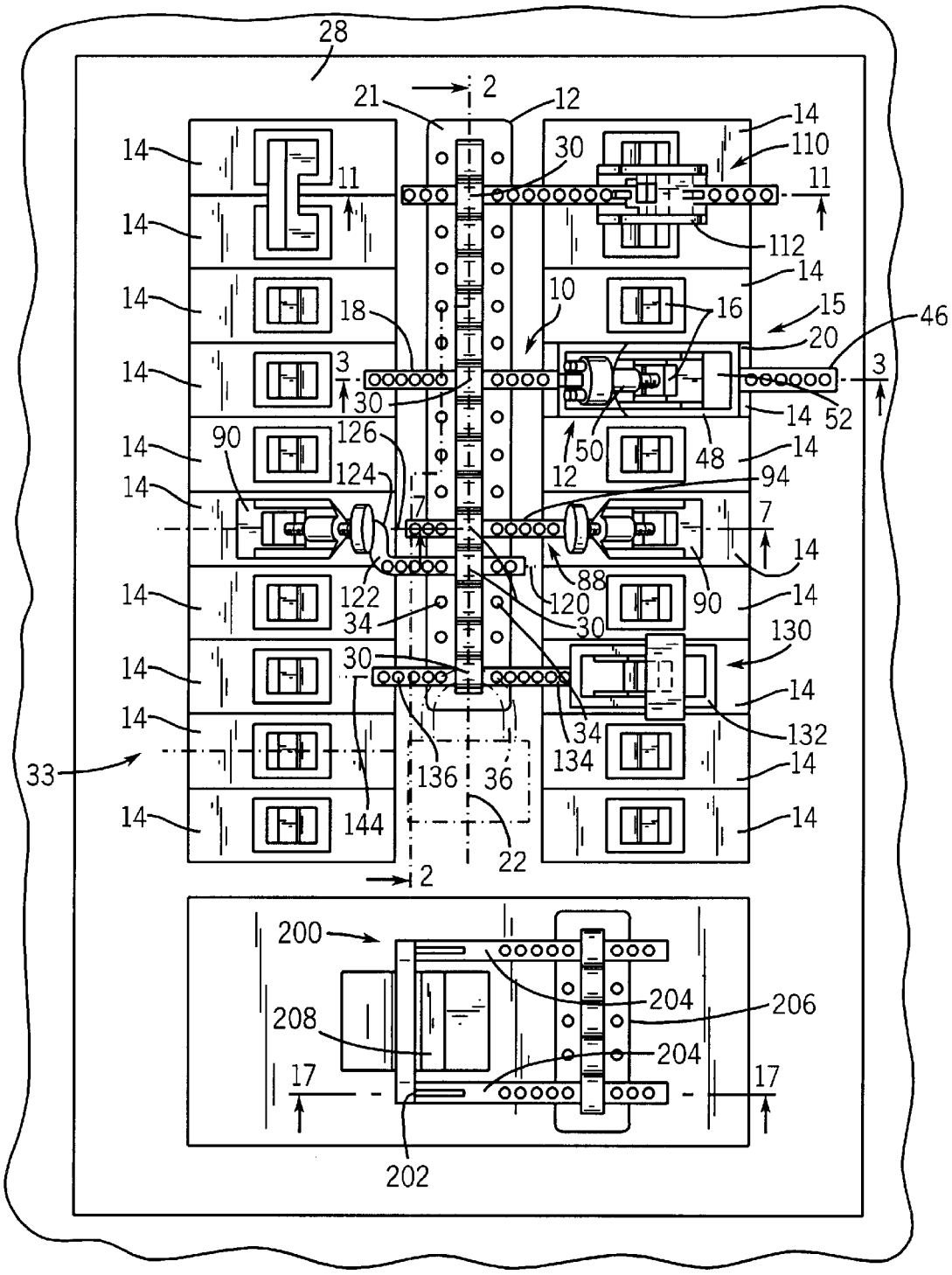
FIG. 1 is a front view of a circuit breaker panel with switch lock outs incorporating the present invention locking out circuit breakers in the panel.

Referring to FIGS. 1–4, a switch lever lock out assembly 10 includes a lock rail 12 mounted adjacent a row of circuit breakers 14 and a lock arm assembly 15. Each circuit breaker 14 includes a lever 16 movable between an "On" position and an "Off" position. The lock arm assembly 15 includes a lock arm 18 fixable to the lock rail 12 and an engaging head 20 which engages one of the breaker levers 16. The lock arm 18 can be locked to the lock rail 12 to prevent unauthorized disengagement of the lock arm 18 from the lock rail 12, and thus unauthorized movement of the circuit breaker lever 16. Advantageously, every component of the switch lever lock out assembly 10 can be formed by plastic injection molding to provide an inexpensively fabricated assembly.

The circuit breakers 14 can be any commercially available circuit breaker 14 having a lever 16 movable between two or more positions. Although, locking out a circuit breaker is disclosed herein, the present invention can be used to lock out any switch having a lever movable between two or more positions.

As shown in FIGS. 1–4, the lock rail 12 is fixed adjacent to the row of breakers 14, and has a base 21 defining a longitudinal axis 22 substantially perpendicular to the axis of rotation of the circuit breaker levers 16. The base 21 has a top 24 and a bottom 26, and is fixed to a switch panel face 28, such as a surface of the circuit breaker box, panel, and the like, adjacent the breakers 14. The base 21 can be fixed to the switch panel face 28 using methods known in the art, such as by an adhesive applied to the base bottom 26, screws extending through the base 21, and the like.

A plurality of arches 30 extend from the base top 24, and define a plurality of transverse openings 32 above the base 21. Each opening 32 is, preferably, aligned with a horizontal center line 33 of a circuit breaker 14, and extends substantially parallel to the direction of movement of the circuit breaker levers 16. Preferably, the arches 30 are formed as an integral part of the base 21. Although arches 30 are described herein, other structures can be provided to form openings 32 above or in the base 21 for receiving a portion of the lock arm 18, such as open ended boxes, through bores formed in the base 21, a clamp structure which pivots away from the base 21, and the like, without departing from the scope of the present invention.

Figure 4:
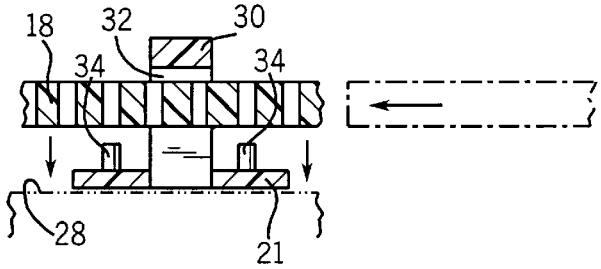
FIG. 4 is a detailed view of the lock rail of FIG. 1.

Pins 34 extend upwardly from the base top 24 in front of and behind each opening 32 for engagement with the lock arm 18 received in the opening 32. The engaged pins 34 prevent transverse movement of the lock arm 18 through the opening 32. Preferably, as shown in FIG. 4, each opening 32 is sized such that the lock arm 18 can be slipped into the opening 32 above the pins 34, and the lock arm 18 can be pressed downwardly into engagement with the pins 34 at both ends of the opening 32 to prevent transverse movement of the lock arm 18. When the pins 34 engage the lock arm 18, a lock shackle 36 can be slipped through the opening 32 above the lock arm 18 to prevent disengagement of the lock arm 18 from the pins 34.

As shown in FIGS. 1–6, the lock arm assembly 15 includes an elongated lock arm 18 having one end 38 extending through the lock rail opening 32 and an opposing end 40 fixed to the circuit breaker engaging head 20. The lock arm 18 includes a bottom surface 42 having a plurality of downwardly opening aligned holes 44 for engaging the pins 34. The lock arm 18 slips through one of the lock rail openings 32, and each pin 34 aligned with the opening 32 is received in one of the holes 44 to prevent horizontal movement of the lock arm 18 through the opening 32. Although downwardly opening holes 44 are described herein, throughholes as shown in the FIGS. can be provided without departing from the scope of the present invention.

A second elongated lock arm 46 can be provided which extends from the engaging head 20. The second lock arm 46 provides the ability to prevent movement of the lever 16 in a direction opposite to the direction of movement prevented by the first lock aim 18. Preferably, in this embodiment the second lock arm 46 extends away from the engaging head 20 in a direction opposite to the first lock aim 18. Although a second lock arm 46 is disclosed, it is not required to practice the invention.

Figure 5:
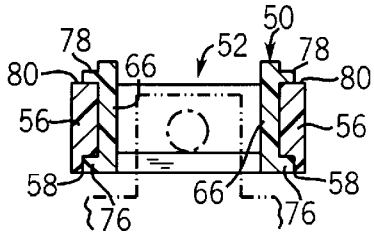
FIG. 5 is a sectional view along line 5—5 of FIG. 3.
Figure 6:
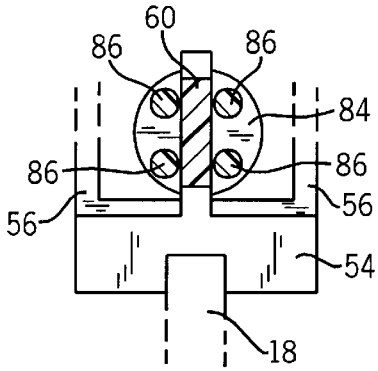
FIG. 6 is a sectional view along line 6—6 of FIG. 3.
Figure 10:
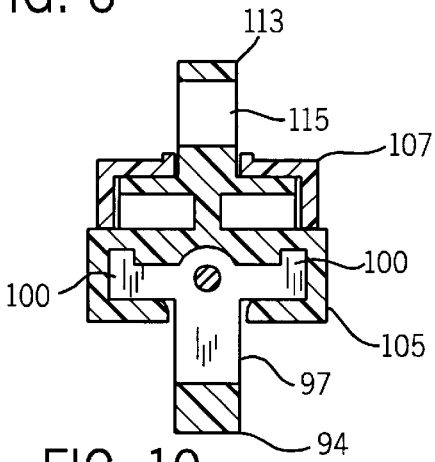
FIG. 10 is a sectional view along line 10—10 of FIG. 9.
Figure 3:
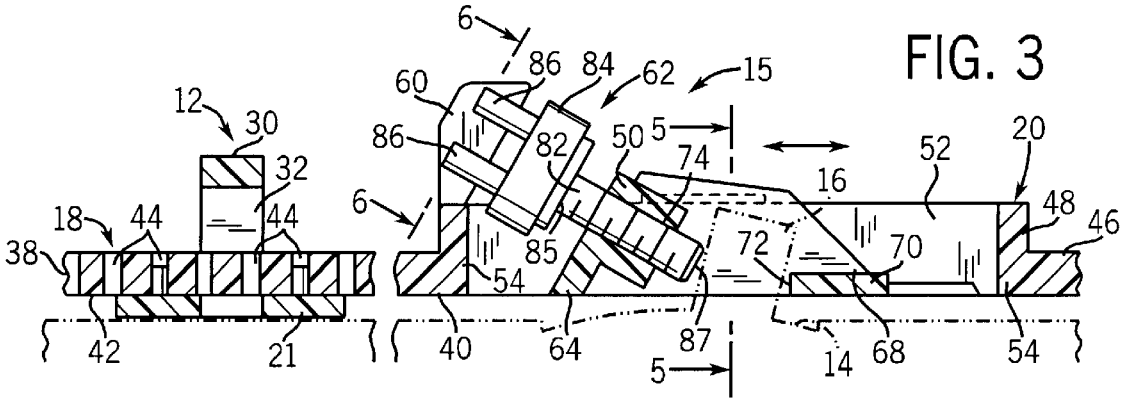
FIG. 3 is a sectional view of one embodiment of a lock arm assembly along line 3—3 of FIG. 1.
Figure 7:
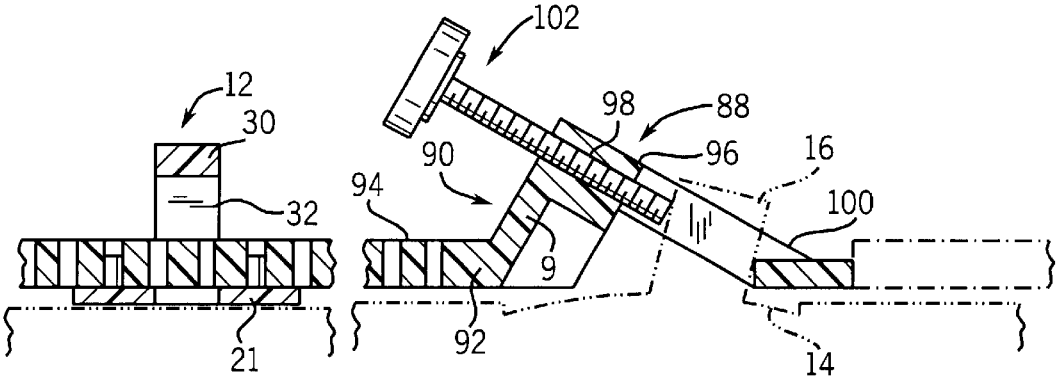
FIG. 7 is a sectional view of a second embodiment of a lock arm assembly along line 7—7 of FIG. 1.
Figure 9:
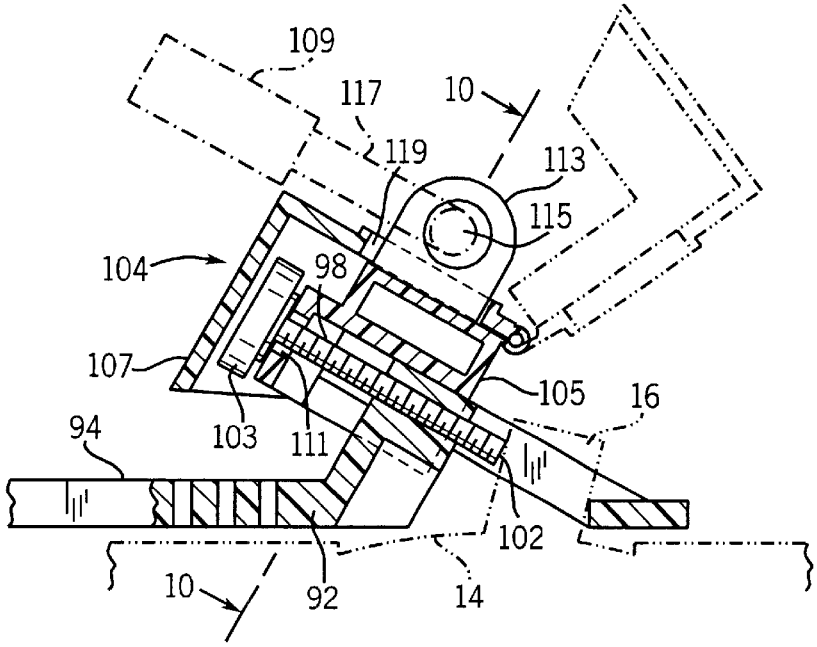
FIG. 9 is a sectional view of the lock arm assembly of FIG. 8 with the lock assembly locked over the thumbwheel head.
Figure 8:
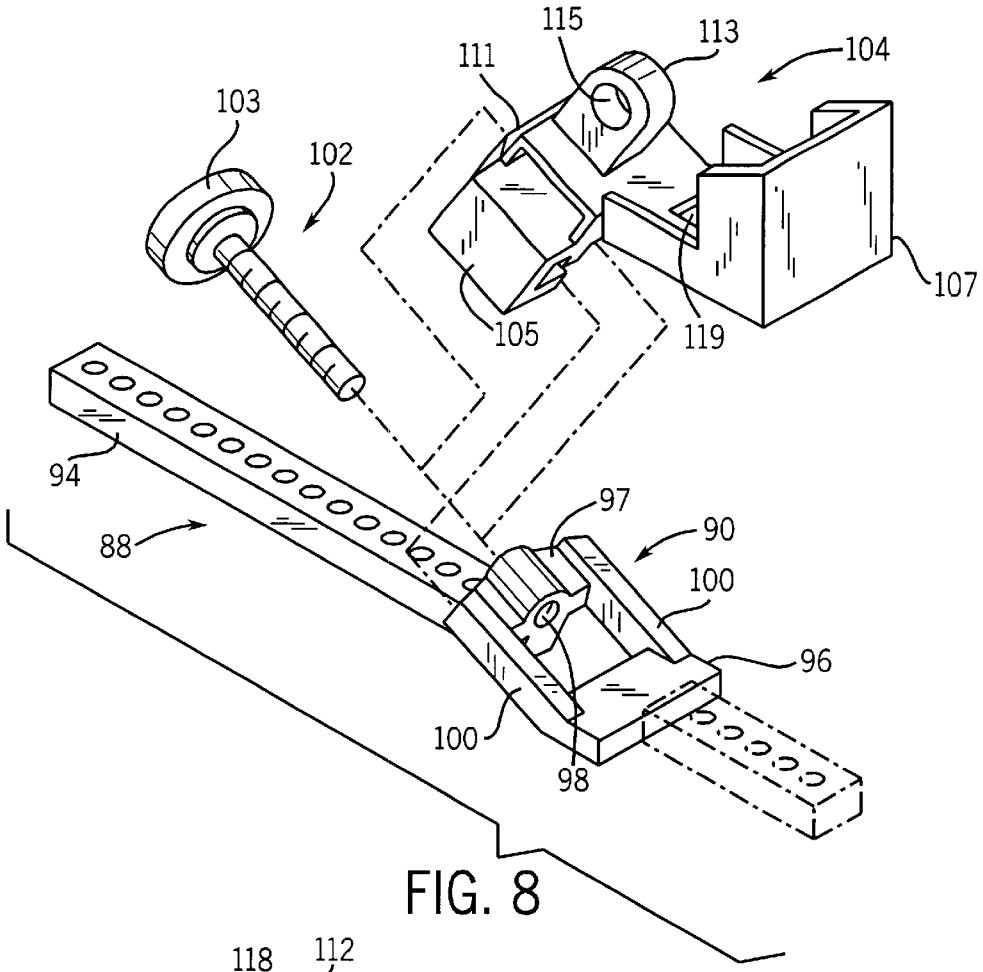
FIG. 8 is an exploded view of the lock arm of FIG. 7 with a lock assembly.

Referring to FIGS. 3, 5, and 6, the circuit breaker engaging head 20 includes a locking cleat 50 which clamps the engaging head 20 onto the circuit breaker lever 16 of one of the breakers 14. The locking cleat 50 clamps onto the lever 16 such that the engaging head 20 cannot be lifted away from the breaker 14 and allow undesired movement of the circuit breaker lever 16 when the lock arm 18 is locked to the lock rail 12. The engaging head 20 includes a rectangular frame 48 fixed to the ends 40 and 46 of the lock arm 18, and the lever 16 extends through an opening 52 defined by the frame 48. The locking cleat 50 is slidably mounted for forwardly and rearwardly movement in the opening 52.

The frame 48 includes opposing end members 54 joined by side members 56 to define the frame opening 52. Longitudinal slots 58 formed in the frame side members 56 engage the locking cleat 50 to slidably retain the locking cleat 50 in the opening 52. A lock plate 60 extends upwardly from one of the frame end members 54 to prevent rotation of a thumbwheel 62 threadably engaging the locking cleat 50.

The locking cleat 50 includes a base 64 having a pair of arms 66 which extend from the base 64 substantially parallel to the frame side members 56. The lock arms 66 are joined at arm distal ends 68 by a cross bar 70 to define an aperture 72. An internally threaded bore 74 formed in the base 64 receives the externally threaded thumbwheel 62 which clamps the circuit breaker lever 16 extending through the aperture 72 against the cross bar 70.

As shown in FIG. 5, tabs 76 and curbs 78 extending outwardly from the cleat arms 66 engage the frame side members 56 to cooperatively slidably retain the locking cleat 50 in the frame opening 52. Two tabs 76 extend outwardly from each cleat arm 66, and engage the frame slots 58 to prevent upwardly movement of the locking cleat 50 in the frame opening 52. Each curb 78 extends outwardly from each cleat arm 66, and engages the adjacent frame side member top 80 to prevent downwardly movement of the locking cleat 50 in the frame opening 52.

Referring back to FIGS. 3, 5, and 6, the thumbwheel 62 includes a threaded post 82 having a head 84 fixed to one end 85. The threaded post 82 threadably engages the threaded bore 74 formed in the locking cleat base 64 to axially move the post 82 through the bore 74 between an engaged position and a disengaged position. In the engaged position, the post end 87 passing through the bore 74 engages the circuit breaker lever 16 extending through the cleat aperture 72 to clamp the lever 16 against the cross bar 70, and thus clamp the locking cleat 50 onto the lever 16.

Lock posts 86 extending axially from the thumbwheel head 84 away from the threaded post 82 engage the frame lock plate 60. When engaged, the lock posts 86 prevent rotation of the thumbwheel 62 when the locking cleat 50 abuts the frame end member 54 supporting the lock plate 60. In the disengaged position, the post end 87 is not engaged with the lever 16, and the lock posts 86 are not engaged with the lock plate 60.

In use, the lock rail 12 is fixed to the switch panel face 28 adjacent the circuit breakers 14. The lock arm 18 is inserted into one of the lock rail openings 32 which aligns the engaging head 20 over the desired circuit breaker lever 16. The circuit breaker lever 16 is slipped through the cleat aperture 72, and the thumbwheel 62 is rotated to clamp the locking cleat 50 onto the lever 16. Once the locking cleat 50 is clamped onto the lever 16, the engaging head frame 48 is moved relative to the locking cleat 50 to engage the lock posts 86 with the frame lock plate 60. Engaging the lock posts 86 with the lock plate 60 prevents rotation of the thumbwheel 62 and disengagement of the locking cleat 50 from the lever 16.

Once the lock posts 86 are engaged with the lock plate 60, the lock arm 18 is pressed against the lock rail 12 to slip the pins 34 at each end of the lock rail opening 32 into the pin holes 44 formed in the lock rail bottom surface 42 to prevent movement of the lock arm 18 through the opening 32, and thus movement of the circuit breaker lever 16. A lock shackle 36 is then slipped through the opening 32 receiving the lock arm 18, and the lock shackle 36 is locked to prevent disengagement of the lock arm 18 from the lock rail pins 34.

In a second embodiment of the present invention shown in FIGS. 1, 7–10, a lock arm assembly 88 includes a circuit breaker engaging head 90 joined to one end 92 of a lock arm 94 for engaging the lever 16 of a circuit breaker 14. The head 90 includes a frame 96 which wraps around the circuit breaker lever 16 to prevent lever movement. One end 97 of the rectangular frame 96 includes a threaded bore 98 having an axis substantially aligned with rectangular frame sides 100.

A thumbwheel 102, such as described above, threadably engages the threaded bore 98. Rotation of the thumbwheel 102 axially moves the thumbwheel 102 through the bore 98 into engagement with the lever 16 to clamp the head 90 to the lever 16. Preferably, the thumbwheel 102 includes a thumbwheel head 103 to facilitate rotation of the thumbwheel 102.

A lock assembly 104 covers the thumbwheel head 103 to prevent rotation of the thumbwheel 102 , and thus disengagement of the engaging head 90 from the lever 16. The lock assembly 104 includes a lock assembly base 105 slidably fixed to the head frame sides 100 and a cover 107 which covers the thumbwheel head 103. The cover 107 can be locked over the thumbwheel head 103 using a lock 109 to prevent rotation of the thumbwheel 102.

The lock assembly base 105 wraps around the frame sides 100, and has an aperture 111 which aligns with the frame threaded bore 98 when the lock assembly base 105 is slidably mounted to the frame 96. The thumbwheel 102 is inserted through the aperture 111 to threadably engage the threaded bore 98 and sandwich a portion of the lock assembly base 105 between the frame 96 and thumbwheel head 103. Advantageously, when the base portion is sandwiched between the thumbwheel head 103 and the frame 96, the lock assembly base 105 cannot be separated from the engaging head 90 without removing the thumbwheel 102. A lug 113 extends away from the lock assembly base 105, and includes an opening 115 for receiving a lock shackle 117.

The cover 107 is hingedly connected to the lock assembly base 105, and includes an opening 119 aligned with the lug 113 when the cover 107 is pivoted over the lock assembly base 105 and thumbwheel head 103. The lug 113 extends through the opening 119, and when the lock shackle 117 is inserted into the lug opening 115, the cover 107 cannot be pivoted away from the lock assembly base 105 and thumbwheel head 103, thus preventing access to the thumbwheel head 103. Although the cover 107 is hingedly connected to the lock assembly base 105, as disclosed herein, the cover 107 can be separate from the lock assembly base 105 without departing from the scope of the present invention.

Figure 2:
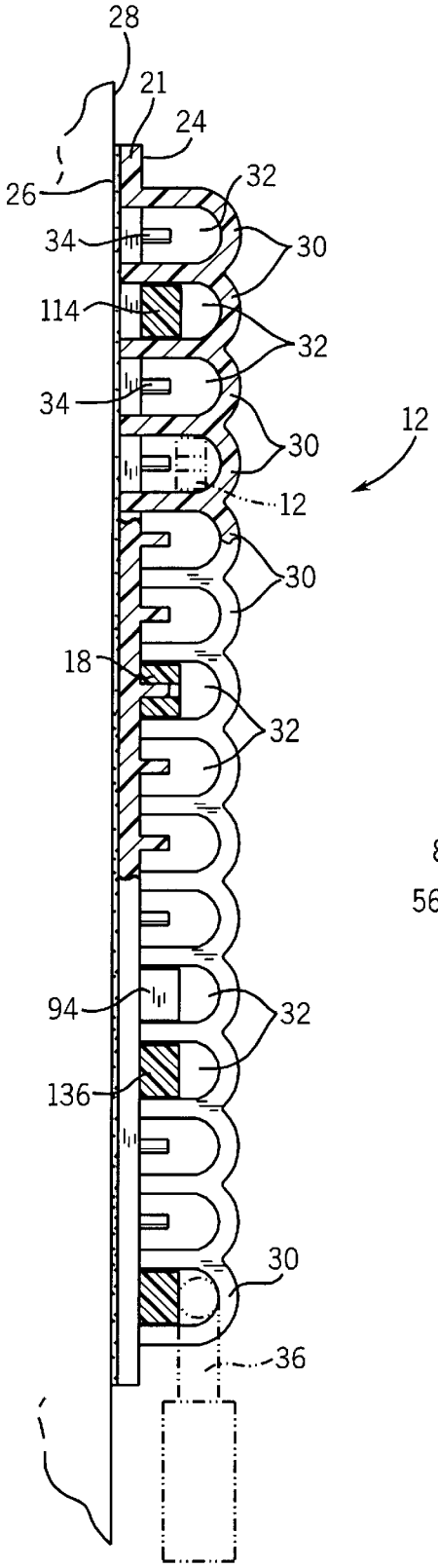
FIG. 2 is a sectional view along line 2—2 of FIG. 1.

As shown in FIGS. 1 and 2, the head 90 can be offset from the lock arm longitudinal axis 120 to lock-out adjacent breakers 14 with one lock rail 12. The lock arm 122 is formed with an offset portion 124 having a longitudinal axis 126 parallel to and spaced from the lock arm longitudinal axis 120 extending through the opening 32. The offset portion 124 of the lock arm 122 offsets the head 90 such that it is aligned with an adjacent breaker 14 not aligned with the lock arm axis 120 extending through the opening 32.

Figure 12:
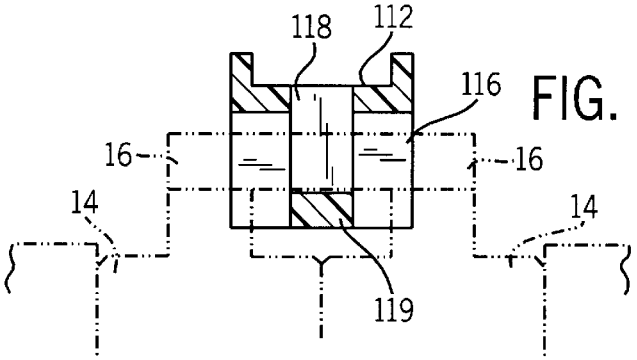
FIG. 12 is a sectional view along line 12—12 of FIG. 11.
Figure 11:
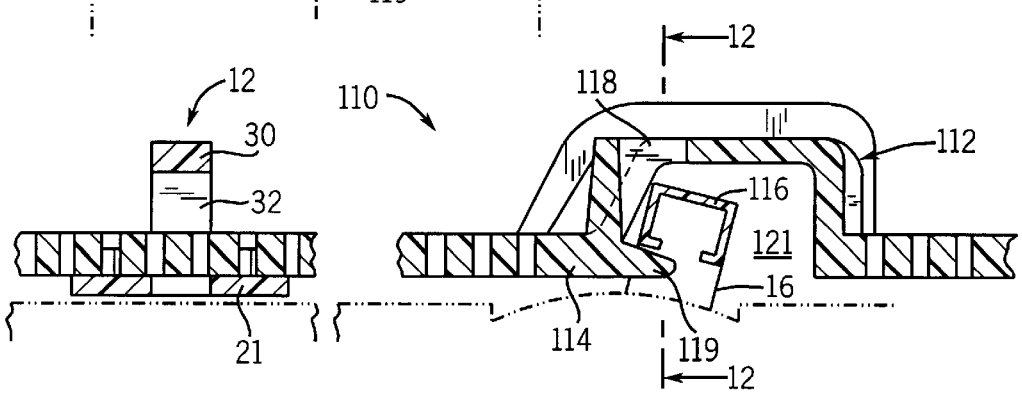
FIG. 11 is a sectional view of a third embodiment of a lock arm assembly along line 11—11 of FIG. 1.
Figure 13:
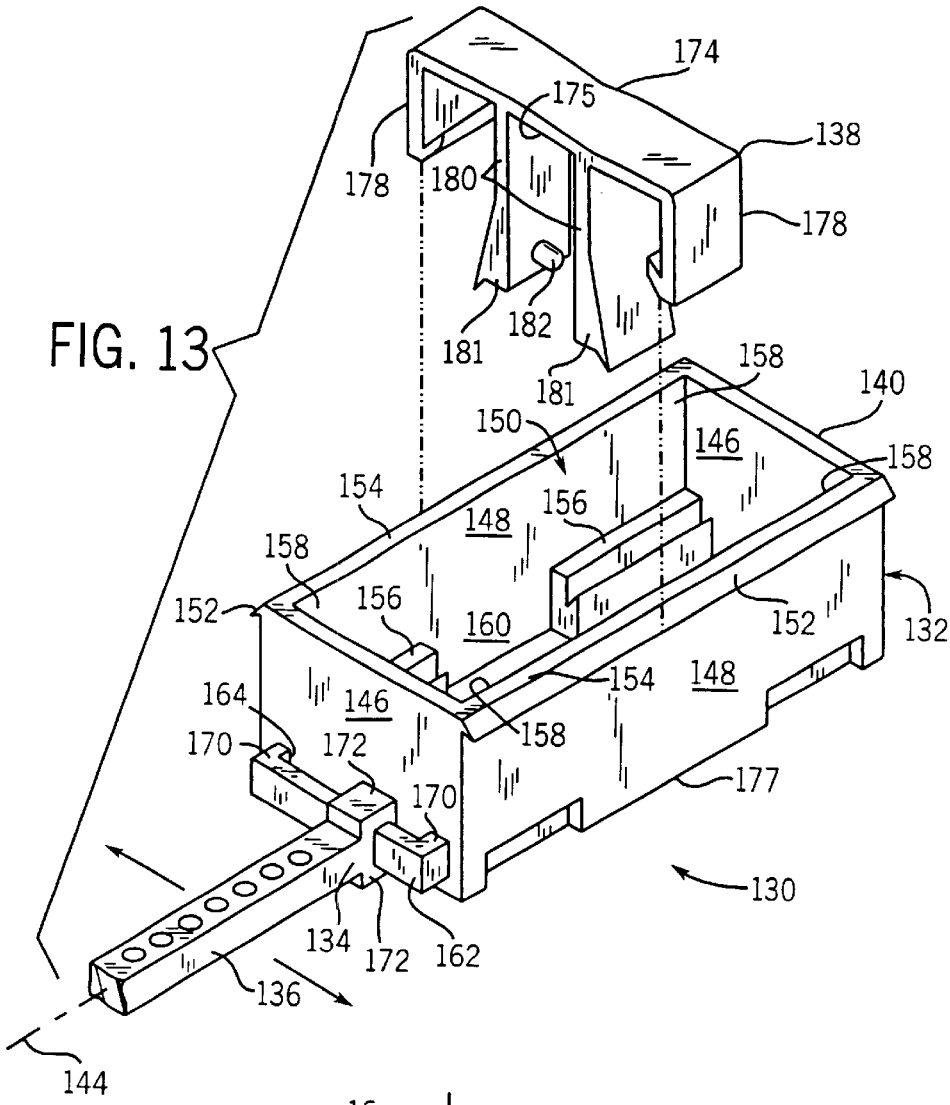
FIG. 13 is an exploded view of a fourth embodiment of a lock arm assembly.
Figure 14:
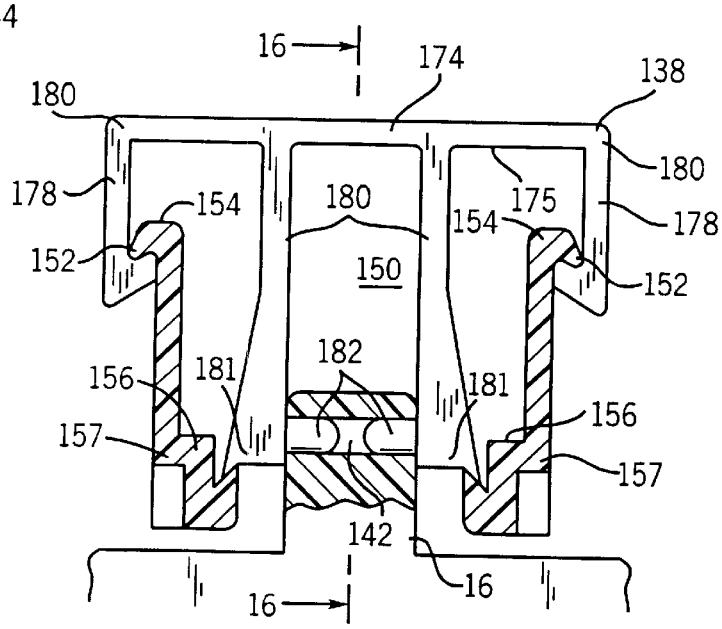
FIG. 14 is a sectional view of the lock arm assembly of FIG. 13 in an engaged position with a circuit breaker lever.

In a third embodiment shown in FIGS. 1, 11, and 12, a lock arm assembly 110 includes a circuit breaker engaging head 112 fixed to an end of a lock arm 114. The engaging head 112 passes over the circuit breaker lever 16, and defines a cavity 115 which receives the lever 16. An opening 118 in the engaging head 112 allows the user to view the position of the covered lever 16.

A toe 119 extends from the engaging head 112 into the cavity 121, and slips underneath a breaker tie bar 116, or lever notch, to prevent a user from lifting the engaging head 112 away from the tie bar 116 when the lock arm 114 is locked in place. Advantageously, this embodiment can be used with a breaker having two levers linked together with a tie bar, such as two single throw circuit breakers.

In a fourth embodiment of the present invention shown in FIGS. 1, 2, and 13–16, a lock arm assembly 130 has a circuit breaker engaging head 132 slidably fixed to an end 134 of a lock arm 136. The engaging head 132 includes a locking cleat 138 slidably mounted in a frame 140. The locking cleat 138 clamps onto the circuit breaker holes 142 (shown in FIGS. 14 and 15) formed through the circuit breaker lever 16. Advantageously, the slidably mounted circuit breaker engaging head 132 allows adjustment of the engaging head 132 when one of the lock arm openings 32 is not properly aligned with the desired circuit breaker lever 16.

The rectangular frame 140 includes opposing end members 146 joined by side members 148 to define a frame opening 150. Outwardly extending lips 152 are formed along the top 154 of each side member 148 and engage the locking cleat 138. Inwardly extending shelves 156 are formed proximal each end 158 of the side members 148 proximal each side member bottom 177, and engage the locking cleat 138 when clamping onto the lever 16. A gap 160 is interposed between each shelf pair 155 for disengaging the locking cleat 138 from the lever 16.

An attachment bar 162 is formed as an integral part of one frame end member 146 to slidably fix the lock arm end 134 to the frame 140. The attachment bar 162 extends along the width of the frame end member 146, and includes slots 164 formed in the top 166 and bottom 168 of the attachment bar 162. Stops 170 formed at each end of the slots 164 prevent the lock arm end 134 from sliding off the attachment bar 162.

The lock aim 136 is engagable with the lock rail 12, such as described above, and has one end 134 slidably fixed to the circuit breaker engaging head 132 to allow slidable movement of the engaging head 132 perpendicular to the longitudinal axis 144 of the lock arm 136. The lock aim end 134 is C-shaped having legs 172 which wrap around the attachment bar 162. The legs 172 include opposing tabs 179 which extend into the attachment bar slots 164 to prevent the lock arm 136 from separating from the frame 140.

Referring to FIGS. 13–16, the locking cleat 138 slips into the frame opening 150 to clamp onto the holes 142 formed in the lever 16. The locking cleat 138 includes a base 174 which is disposed above the top 154 of each frame side member 148. An outer arm 178 formed at each end of the base 174 extends substantially perpendicularly from the base bottom 175. Each arm 178 wraps around the lip 152 formed on the adjacent frame side member 148. Advantageously, the arms 178 allow slidable movement of the locking cleat 138 relative to the frame side members 148 while preventing the locking cleat 138 from inadvertently separating from the frame 140.

A pair of opposing outwardly, biased resilient legs 180 extend from the base bottom 175, and are interposed between the arms 178. Each leg 180 has a distal end 181 which slips through the frame opening 150. An inwardly extending pin 182 is formed as an integral part of each leg 180 proximal each leg distal end 181. The opposing pins 182 engage the holes 142 formed in the lever 16 to clamp the. assembly of the engaging head 132 and locking cleat 138 to the lever 16.

Referring to FIGS. 1, 2, and 13–16, in use, when locking onto a lever 16, the lock arm 136 is aligned with an opening 32 in the lock rail 12, and the engaging head frame 140 is positioned over the lever 16, such that the lever 16 is aligned between the gaps 160 between each pair of inwardly extending shelves 156. The locking cleat 138 is aligned with the lever 16, such that the resilient legs 180 are aligned with the gaps 160, and the legs 180 are inserted through the frame opening 150 until the inwardly extending pins 182 are aligned with the lever holes 142.

Once the pins 182 are aligned with the lever holes 142, the legs 180 are urged inwardly forcing each pin 182 into each end of the lever holes 142 in an engaged position. Once the pins 182 are engaged in the lever holes 142, the frame 140 is slipped rearwardly or forwardly relative to the lever 16, and each leg 180 engages one of the shelves 156. The shelves 156 prevent the legs 180 from spreading apart and disengaging the pins 182 from the lever holes 142. The lock arm 136 is then locked relative to the lock rail 12 as described above for the first embodiment.

The lever 16 is unlocked by disengaging the lock arm 136 from the lock rail 12, and sliding the lock arm 136 relative to the lever 16 to align the legs 180 with the gap 160. The legs 180 spring apart into the gap 160, and the pins 182 disengage from the lever holes 142 to a disengaged position. Once the pins 182 are disengaged from the lever holes 142, the lock arm assembly 130 is retracted from the lever 16.

A fifth embodiment, shown in FIGS. 1 and 17, is a lock arm assembly 200 having a circuit breaker engaging head 202 and a pair of substantially parallel lock arms 204. Both lock arms 204 engage a lock rail 206, such as described above for lock rail 12, to maintain the engaging head 202 in engagement with a circuit breaker lever 208. The engaging head 202 engages the lever 208 to prevent movement of the lever 208 when the lock arms 204 are engaged with the lock rail 206. This particular embodiment is especially useful for multiple pole circuit breakers or switches having wide levers.

While there has been shown and described what are at present considered the preferred embodiments of the invention, it will be obvious to those skilled in the art that various changes and modifications can be made therein without departing from the scope of the invention defined by the appended claims. For example, the lock arm can be slidably mounted to the engaging head in the first embodiment, such as disclosed in the fourth embodiment, and the fourth embodiment can be fixed to an offset lock arm, such as disclosed in the first embodiment.

I claim:

1. A switch lever lock out assembly engagable with a switch having a lever positionable in at least two positions, said assembly comprising:

a lock rail fixable relative to the switch;

at least one transverse opening formed in said lock rail;

an elongated lock arm having one end extending through said opening and an opposing end extending toward the switch;

a switch engaging head fixed to said lock arm opposing end and clampable to the lever.

2. The switch lever lock out assembly of claim 1, in which at least one pin extends from said lock rail and is aligned with said opening, and at least one pin hole formed in said lock arm engages said pin, wherein engaging said pin with said pin hole prevents movement of said lock arm through said opening to prevent movement of the lever when engaged with said head.

3. The switch lever lock out assembly of claim 2, in which a locking mechanism inserted through said opening prevents disengagement of said pin from said pin hole.

4. The switch lever lock out assembly of claim 1, in which said head includes a cleat slidably mounted to a frame, and said cleat clamps onto the lever.

5. The switch lever lock out assembly of claim 4, in which said cleat has a threaded opening and a threaded member threadably engaging said threaded opening, and said threaded member has one end engagable with said lever, wherein rotating said threaded member axially moves said threaded member end between an engagement position and a disengagement position.

6. The switch lever lock out assembly of claim 5, in which said threaded member has an opposing end, and said opposing end includes at least one axially extending tab engagable with a stop fixed to said head, wherein engagement of said tab with said stop prevents rotation of said threaded member and disengagement with the lever.

7. The switch lever lock out assembly of claim 4, in which said cleat includes opposing pins movable between an engagement position and a disengagement position.

8. The switch lever lock out assembly of claim 1, in which said head is slidably mounted to said lock arm opposing end.

9. The switch lever lock out assembly of claim 1, in which said head is offset from a longitudinal axis defined by said lock arm.

10. The switch lever lock out assembly of claim 1, in which a second lock arm is fixed to said head.

11. A switch lever lock out assembly engagable with a switch having a lever positionable in at least two positions, said assembly comprising:

a lock rail fixable relative to the switch;

at least one transverse opening formed in said lock rail;

an elongated lock arm having one end extending through said opening and an opposing end extending toward the switch;

a switch engageable head slidably mounted to said lock arm opposing end.

12. The switch lever lock out assembly of claim 11, in which at least one pin extends from said lock rail and is aligned with said opening, and at least one pin hole formed in said lock arm engages said pin, wherein engaging said pin with said pin hole prevents movement of said lock arm through said opening to prevent movement of the lever when engaged with said head.

13. The switch lever lock out assembly of claim 12, in which a locking mechanism inserted through said opening prevents disengagement of said pin from said pin hole.

14. The switch lever lock out assembly of claim 11, in which said head includes a cleat slidably mounted to a frame, and said cleat clamps onto the lever.

15. The switch lever lock out assembly of claim 14, in which said cleat has a threaded opening and threaded member threadably engaging said threaded opening, said threaded member has one end engagable with said lever, wherein rotating said threaded member axially moves said threaded member end between an engagement position and a disengagement position.

16. The switch lever lock out assembly of claim 15, in which said threaded member has an opposing end, and said opposing end includes at least one axially extending tab engagable with a stop fixed to said head, wherein engagement of said tab with said stop prevents rotation of said threaded member and disengagement with the lever.

17. The switch lever lock out assembly of claim 14, in which said cleat includes opposing pins movable between an engagement position and a disengagement position.

18. The switch lever lock out assembly of claim 11, in which said head is offset from a longitudinal axis defined by said lock arm.

19. The switch lever lock out assembly of claim 11, in which a second lock arm is fixed to said head.

20. A switch lever lock out assembly engagable with a switch having a lever positionable in at least two positions, said assembly comprising:

a lock rail fixable relative to the switch;

at least one transverse opening formed in said lock rail;

an elongated lock arm having one end extending through said opening and an opposing end extending toward the switch, said one end defining a longitudinal axis;

a switch engageable head fixed to said lock arm, and offset from said longitudinal axis.

21. The switch lever lock out assembly of claim 20, in which at least one pin extends from said lock rail and is aligned with said opening, and at least one pin hole formed in said lock arm engages said pin, wherein engaging said pin with said pin hole prevents movement of said lock arm through said opening to prevent movement of the lever when engaged with said head.

22. The switch lever lock out assembly of claim 21, in which a locking mechanism inserted through said opening prevents disengagement of said pin from said pin hole.

23. The switch lever lock out assembly of claim 20, in which said head includes a cleat slidably mounted to a frame, and said cleat clamps onto the lever.

24. The switch lever lock out assembly of claim 23, in which said cleat has a threaded opening and threaded member threadably engaging said threaded opening, said threaded member has one end engagable with said lever, wherein rotating said threaded member axially moves said threaded member end between an engagement position and a disengagement position.

25. The switch lever lock out assembly of claim 24, in which said threaded member has an opposing end, and said opposing end includes at least one axially extending tab engagable with a stop fixed to said head, wherein engagement of said tab with said stop prevents rotation of said threaded member and disengagement with the lever.

26. The switch lever lock out assembly of claim 23, in which said cleat includes opposing pins movable between an engagement position and a disengagement position.

27. The switch lever lock out assembly of claim 20, in which said head is slidably mounted to said lock aim.

28. The switch lever lock out assembly of claim 20, in which a second lock aim is fixed to said head.

29. A lock arm engagable with a lock rail to lock out a switch having a lever, said lock arm comprising:

an elongated body having opposing ends, one of said ends being engageable with the lock rail; and a switch engageable head fixed to the other of said ends, and being clampable to the lever.

30. The lock arm of claim 29, in which said head includes a cleat slidably mounted to a frame, and said cleat clamps onto the lever.

31. The lock arm of claim 30, in which said cleat has a threaded opening and threaded member threadably engaging said threaded opening, said threaded member has one end engagable with said lever, wherein rotating said threaded member axially moves said threaded member end between an engagement position and a disengagement position.

32. The lock arm of claim 31, in which said threaded member has an opposing end, and said opposing end includes at least one axially extending tab engagable with a stop fixed to said head, wherein engagement of said tab with said stop prevents rotation of said threaded member and disengagement with the lever.

33. The lock aim of claim 30, in which said cleat includes opposing pins movable between an engagement position and a disengagement position.

34. The lock aim of claim 29, in which said head is slidably mounted to said lock aim.

35. The lock arm of claim 29, in which said head is offset from a longitudinal axis defined by said lock arm.

36. A lock arm engagable with a lock rail to lock out a switch having a lever, said lock aim comprising:

an elongated body having opposing ends, one of said ends being engageable with the lock rail; and a switch engageable head slidably mounted to the other of said ends.

37. The lock arm of claim 36, in which said head is clampable to the lever.

38. The lock arm of claim 36, in which said head includes a cleat slidably mounted to a frame, and said cleat clamps onto the lever.

39. The lock arm of claim 38, in which said cleat has a threaded opening and threaded member threadably engaging said threaded opening, said threaded member has one end engagable with said lever, wherein rotating said threaded member axially moves said threaded member end between an engagement position and a disengagement position.

40. The lock arm of claim 39, in which said threaded member has an opposing end, and said opposing end includes at least one axially extending tab engagable with a stop fixed to said head, wherein engagement of said tab with said stop prevents rotation of said threaded member and disengagement with the lever.

41. The lock arm of claim 38, in which said cleat includes opposing pins movable between an engagement position and a disengagement position.

42. The lock aim of claim 36, in which said head is offset from a longitudinal axis defined by said lock arm.

43. A lock aim engagable with a lock rail to lock out a switch having a lever, said lock arm comprising:

an elongated body having opposing ends and defining a longitudinal axis, one of said ends being engageable with the lock rail; and a switch engageable head fixed to the other of said ends, and being offset from said longitudinal axis.

44. The lock arm of claim 43, in which said head is clampable to the lever.

45. The lock aim of claim 43, in which said head includes a cleat slidably mounted to a frame, and said cleat clamps onto the lever.

46. The lock aim of claim 45, in which said cleat has a threaded opening and threaded member threadably engaging said threaded opening, said threaded member has one end engagable with said lever, wherein rotating said threaded member axially moves said threaded member end between an engagement position and a disengagement position.

47. The lock arm of claim 46, in which said threaded member has an opposing end, and said opposing end includes at least one axially extending tab engagable with a stop fixed to said head, wherein engagement of said tab with said stop prevents rotation of said threaded member and disengagement with the lever.

48. The lock arm of claim 45, in which said cleat includes opposing pins movable between an engagement position and a disengagement position.

49. The lock arm of claim 43, in which said head is slidably mounted to said lock arm.

* * * * *

UNITED STATES PATENT AND TRADEMARK OFFICE

CERTIFICATE OF CORRECTION

PATENT NO. : 6,469,264 B2
DATED : October 22, 2002
INVENTOR(S) : Steven J. Benda It is certified that error appears in the above-identified patent and that said Letters Patent is hereby corrected as shown below:

Title page,
Item [57], ABSTRACT,
Line 12, “aim” should be -- arm --.

Column 2,
Line 24, “aim” should be -- arm --.
Lines 52 and 60, “,” should be -- ; --.

Column 4,
Lines 10 and 12, “aim” should be -- arm --.

Column 6,
Lines 63 and 67, “aim” should be -- arm --.

Column 7,
Line 23, “the.” should be -- the --.

Column 10,
Lines 5, 28, 31, 36, 61 and 63, “aim” should be -- arm --.

Column 11,
Lines 5 and 8, “aim” should be -- arm --.

Signed and Sealed this

Twenty-seventh Day of May, 2003

JAMES E. ROGAN
*Director of the United States Patent and Trademark Office*